US008215512B2

(12) United States Patent
Tardif

(10) Patent No.: US 8,215,512 B2
(45) Date of Patent: Jul. 10, 2012

(54) CAP FOR A CONSUMABLE LIQUID CONTAINER

(75) Inventor: Pierre Tardif, Longueuil (CA)

(73) Assignee: Trudeau Corporation 1889 Inc., Boucherville, Quebec (CA)

( * ) Notice: Subject to any disclaimer, the term of this patent is extended or adjusted under 35 U.S.C. 154(b) by 508 days.

(21) Appl. No.: 12/541,301

(22) Filed: Aug. 14, 2009

(65) Prior Publication Data

US 2011/0036838 A1 Feb. 17, 2011

(51) Int. Cl.
*B65D 51/18* (2006.01)
*B65D 51/04* (2006.01)

(52) U.S. Cl. ..... 220/254.3; 220/254.5; 220/263; 220/281; 215/334

(58) Field of Classification Search ..... 215/317, 215/334; 220/254.1, 254.3, 254.5, 262, 263, 220/281–283, 708, 711, 717, 719
See application file for complete search history.

(56) References Cited

U.S. PATENT DOCUMENTS

| | | | | | |
|---|---|---|---|---|---|
| 4,124,151 | A * | 11/1978 | Hazard | 222/498 |
| 4,146,157 | A * | 3/1979 | Dixon et al. | 222/424 |
| 4,262,802 | A * | 4/1981 | Laauwe | 206/540 |
| 4,607,768 | A * | 8/1986 | Taber et al. | 222/556 |
| 4,645,086 | A * | 2/1987 | Rosenthal | 215/235 |
| 4,911,337 | A * | 3/1990 | Rosenthal | 222/498 |
| 5,273,177 | A * | 12/1993 | Campbell | 220/281 |
| 5,597,096 | A * | 1/1997 | Jeppesen et al. | 222/498 |
| 5,746,338 | A * | 5/1998 | Takahashi et al. | 215/237 |
| 5,850,953 | A * | 12/1998 | Dallas, Jr. | 222/571 |
| 6,045,014 | A * | 4/2000 | Marino | 222/546 |
| 6,253,938 | B1 * | 7/2001 | Zaksenberg et al. | 215/237 |
| 6,305,571 | B1 * | 10/2001 | Chu | 220/719 |
| 6,460,729 | B2 * | 10/2002 | Beecroft | 222/1 |
| 6,488,173 | B2 * | 12/2002 | Milan | 220/713 |
| 6,742,666 | B1 * | 6/2004 | Bried et al. | 215/235 |
| 6,755,318 | B2 * | 6/2004 | Burke et al. | 220/703 |
| 7,854,342 | B2 * | 12/2010 | Burke et al. | 220/23.88 |
| 7,897,123 | B2 * | 3/2011 | Takahashi et al. | 422/559 |
| 7,997,442 | B2 * | 8/2011 | Pinelli | 220/715 |
| 2005/0178775 | A1 * | 8/2005 | Burke et al. | 220/710.5 |
| 2010/0147900 | A1 * | 6/2010 | Tardif | 222/498 |
| 2011/0036838 | A1 * | 2/2011 | Tardif | 220/254.3 |
| 2011/0186573 | A1 * | 8/2011 | Tardif | 220/260 |

* cited by examiner

*Primary Examiner* — Anthony Stashick
*Assistant Examiner* — Brett Edwards
(74) *Attorney, Agent, or Firm* — Ladas & Parry LLP

(57) ABSTRACT

A cap for a consumable liquid container, the cap comprising a seal made of a flexible material and having a top section with a depressibJe portion and a flange portion at least partially surrounding the depressible portion for overlspping the spout of the cap and a peripheral wall extending downwardly from the top section; wherein the seal is in closed position where the depressible portion is above the flange portion and the flange portion has a portion covering the spout for hampering the outward flow of the consumable liquid through the spout, and wherein, upon pressure of a user on the depressible portion, the depressible portion is moved downwardly such that the flange portion is above the depressible portion and frees the spout for allowing unimpeded passage of the consumable liquid outwards from the interior of the container.

21 Claims, 6 Drawing Sheets

CAP FOR A CONSUMABLE LIQUID CONTAINER

FIELD OF THE INVENTION

The present invention relates to a cap for a bottle or a container and in particular to a cap for a consumable liquid container.

BACKGROUND OF THE INVENTION

Consumable liquids, such as oil, vinegar or dressing, are typically kept in containers for pouring out as needed during preparation, serving or consuming of food. Consumable liquid containers may take the form of bottles that are closed with a cork or twist-on cap and opened for pouring when needed. However, because bottles only have one opening air must enter in the same place as consumable liquid escapes, thus causing uneven pouring due to bubbles of air entering the bottle. Furthermore, the shape of a bottleneck often causes the consumable liquid to pour in an uncontrolled flow, or to pour down the side of the bottle, soiling the bottle. Certain bottles are shaped with a spout-like pouring rim but in such bottles, the cork must be inserted deeper in the neck, below the rim thus requiring the user to potentially soil his or her hands while opening and closing the bottle. In certain cases, consumable liquid bottles do not have any cork or cap or closing mechanism of any kind, and stored liquids are exposed to impurities, such as dust, falling into the bottle via the opening.

In the context of the above, it can be appreciated that there is a need in the industry for an improved mechanism for closing consumable liquid containers.

SUMMARY OF THE INVENTION

As embodied and broadly described herein, the present invention provides a cap for a container defining an interior for storing consumable liquid and having an upper portion defining a mouth. The cap comprises an inner member having a top portion with a peripheral wall extending downwardly for covering the mouth of the container and defining an opening having a first central axis, the peripheral wall of the inner member having means for retaining the cap onto the container, the inner member further comprising a first aperture for facing the interior of the container and a second aperture defined by a spout extending upwardly from the top portion, the first and second apertures being in liquid communication for allowing passage of the consumable liquid. The cap further comprises an outer member having a top portion, an inner peripheral wall defining an inner aperture having a second central axis spaced apart from the first central axis, and an external peripheral wall extending downwardly from the top portion of the outer member for covering at least partially the peripheral wall of the inner member. The cap further comprises a seal made of a flexible material. The seal comprises a top section having a depressible portion and a flange portion having an external edge, the depressible portion being located around the second central axis and the flange portion at least partially surrounding the depressible portion for overlapping the spout. The seal further comprises a peripheral wall extending downwardly from the top section and having a lower end mounted to the outer member in an area adjacent the inner aperture of the outer member. The seal is in closed position where the depressible portion is above the flange portion and the flange portion covers the spout and has a portion of its external edge contacting the spout for hampering the outward flow of the consumable liquid outwards from the interior of the container. Upon pressure of a user on the depressible portion, the depressible portion is moved downwardly along the second central axis such that the flange portion is above the depressible portion and frees the spout for allowing unimpeded passage of the consumable liquid outwards from the interior of the container.

The invention also provides a cap for a container defining an interior for storing consumable liquid and having an upper portion defining a mouth, the cap comprising: an inner member having a top portion with a peripheral wall extending downwardly for covering the mouth of the container and defining an opening, the peripheral wall of the inner member having means for retaining the cap onto the container, the inner member further comprising a first aperture for facing the interior of the container and a second aperture defined by a spout extending upwardly from the top portion, the first and second apertures being in liquid communication for allowing passage of the consumable liquid; an outer member having a top portion, an inner peripheral wall defining an inner aperture, and an external peripheral wall extending downwardly from the top portion of the outer member for covering at least partially the peripheral wall of the inner member; and a seal made of a flexible material and comprising a top section having a depressible portion and a flange portion at least partially surrounding the depressible portion for overlapping the spout and a peripheral wall extending downwardly from the top section and having a lower end mounted to the outer member in an area adjacent the inner aperture of the outer member; wherein the seal is in closed position where the depressible portion is above the flange portion and the flange portion has a portion covering the spout for hampering the outward flow of consumable liquid through the spout, and wherein, upon pressure of a user on the depressible portion, the depressible portion is moved downwardly such that the flange portion is above the depressible portion and frees the spout for allowing unimpeded passage of the consumable liquid outwards from the interior of the container; wherein the top portion of the inner member is defined by an inclined surface converging towards a lower opening communicating with the interior of the container; wherein the spout is free from surrounding elements; and wherein the inner member further comprises a lip located below the spout and projecting outwardly such that consumable liquids dripping from, or running down, the spout are collected by the lip and directed towards the lower opening of the top portion of the inner member.

These and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of examples of implementation of the present invention is provided hereinbelow with reference to the following drawings, in which.

Figure 1A:
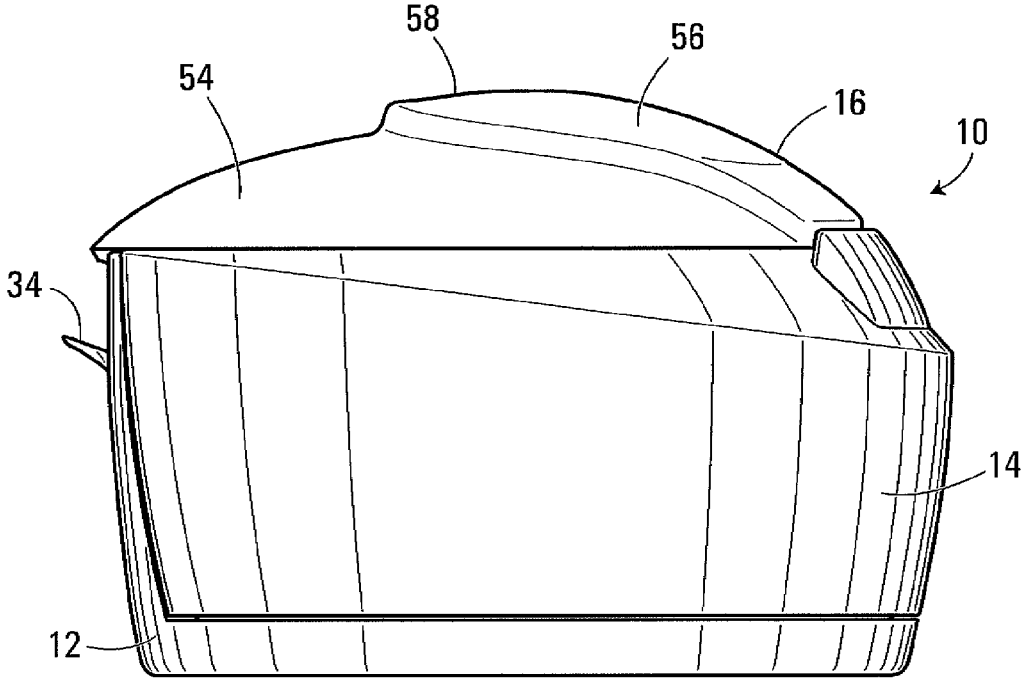
FIG. 1A shows a side elevation view of a cap in a closed configuration in accordance with a non-limiting embodiment.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF THE EMBODIMENTS

Figure 6:
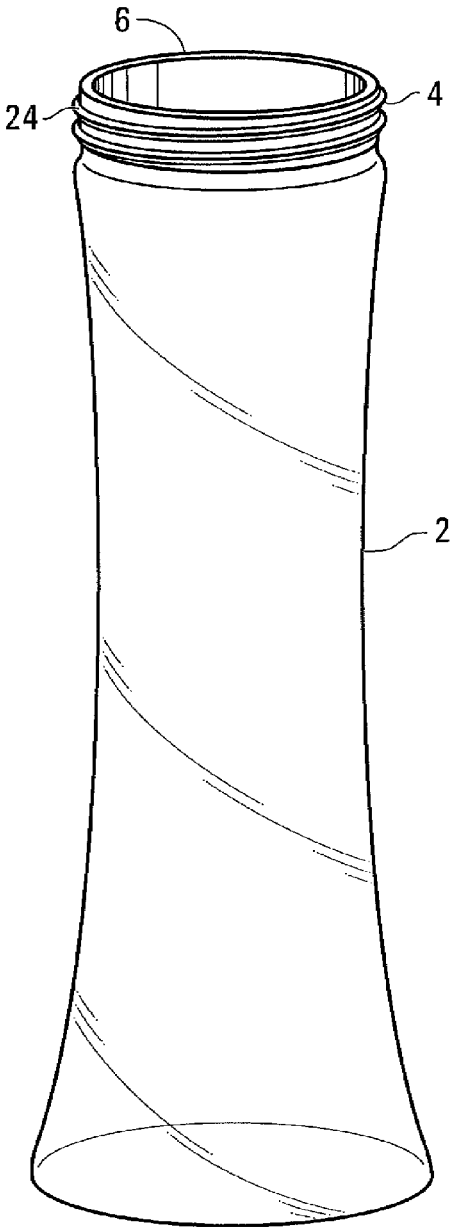
FIG. 6 shows a perspective view of a consumable liquid container.

FIGS. 1A to 3B show a cap 10 for a container. The cap 10 is suitable for use with a container for holding consumable liquid such as oil, vinegar, or dressing. An example of a suitable container 2 is shown in FIG. 6. The container 2 has an upper portion 4 defining a mouth 6 which is to be covered by the cap 10.

Figure 1B:
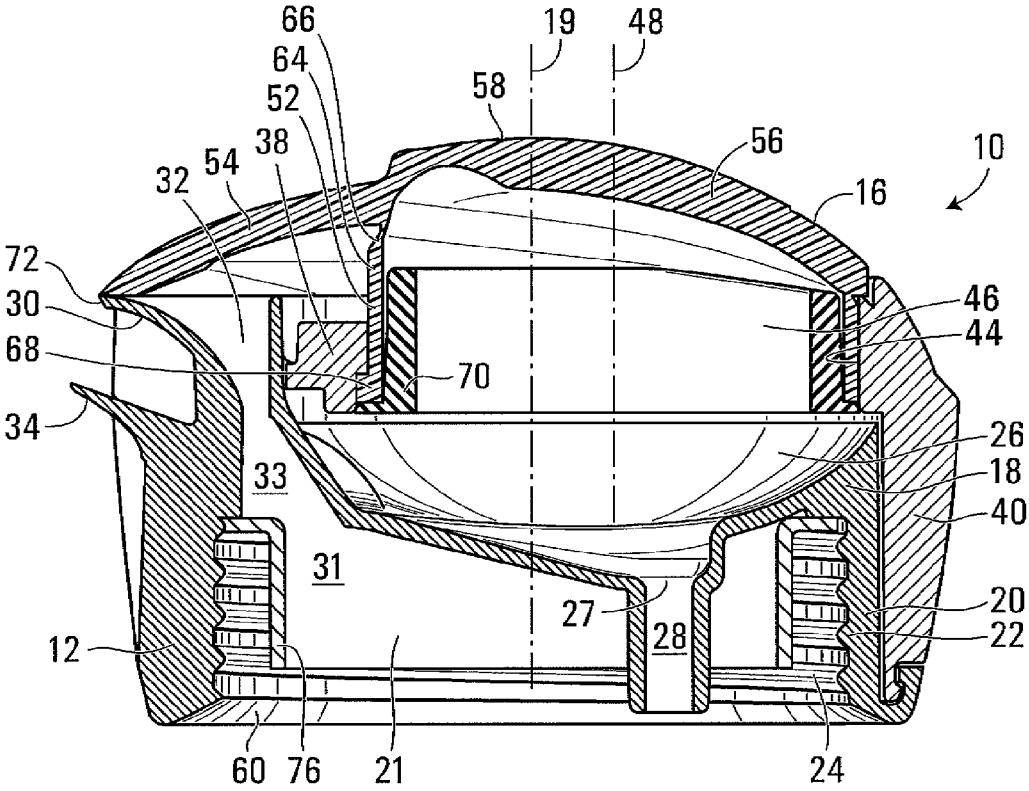
FIG. 1B shows a side elevation cross-sectional view of the cap.
Figure 2A:
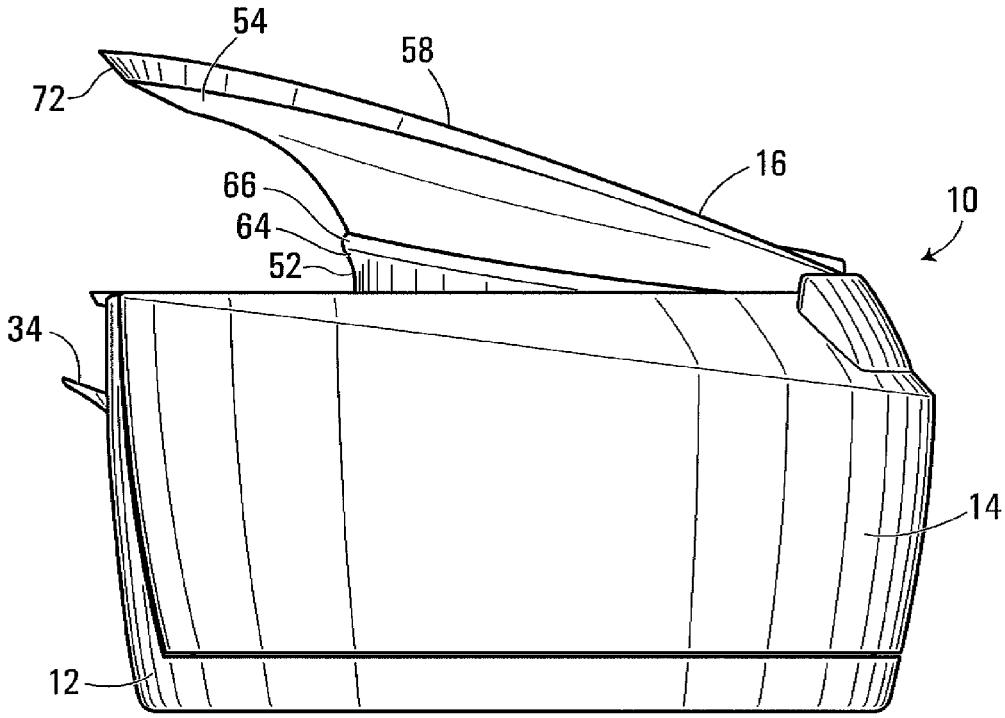
FIG. 2A shows a side elevation view of the cap in an open configuration.
Figure 2B:
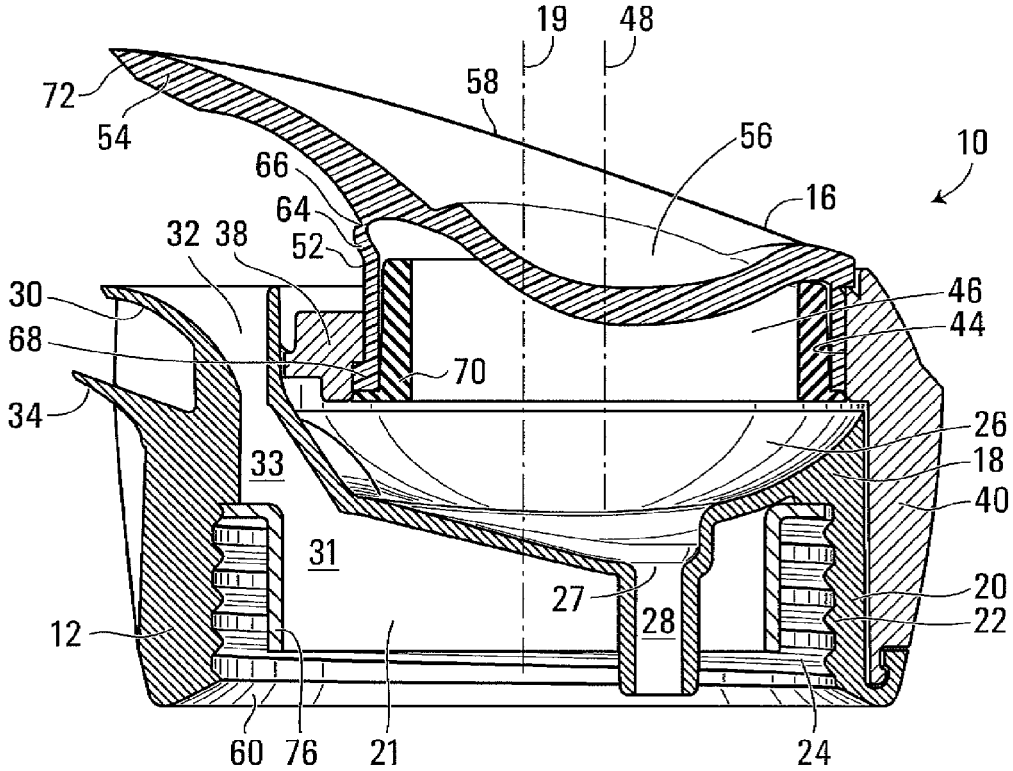
FIG. 2B shows a side elevation cross-sectional view of the cap in the open configuration.
Figure 3A:
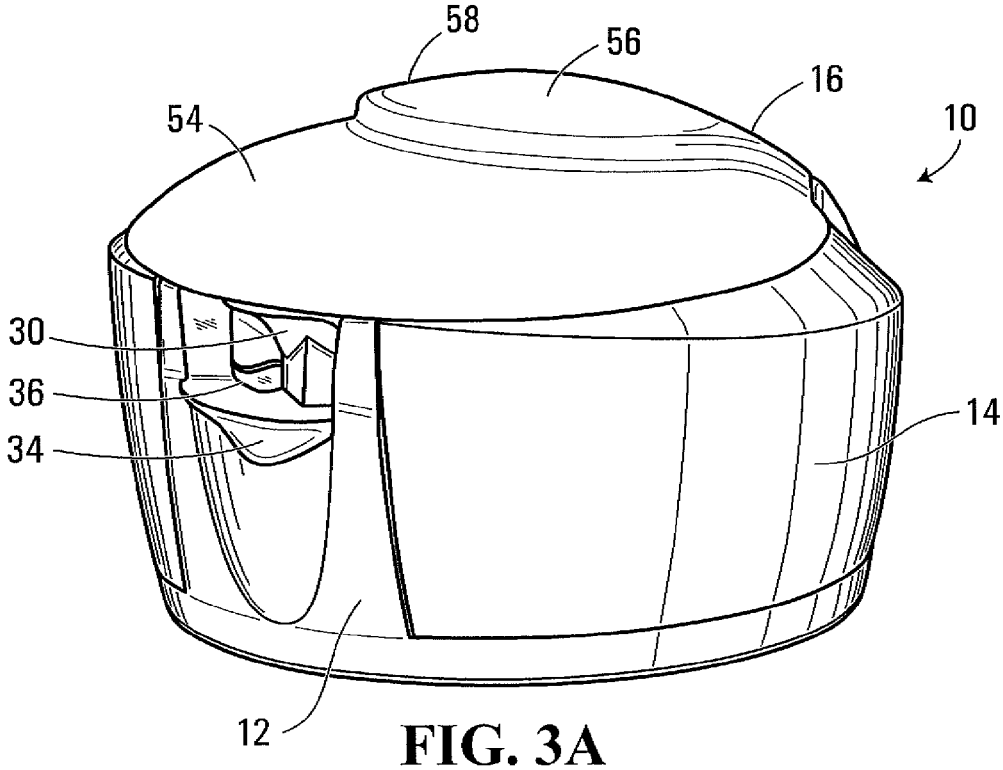
FIG. 3A shows a front perspective view of the cap in the closed configuration.
Figure 3B:
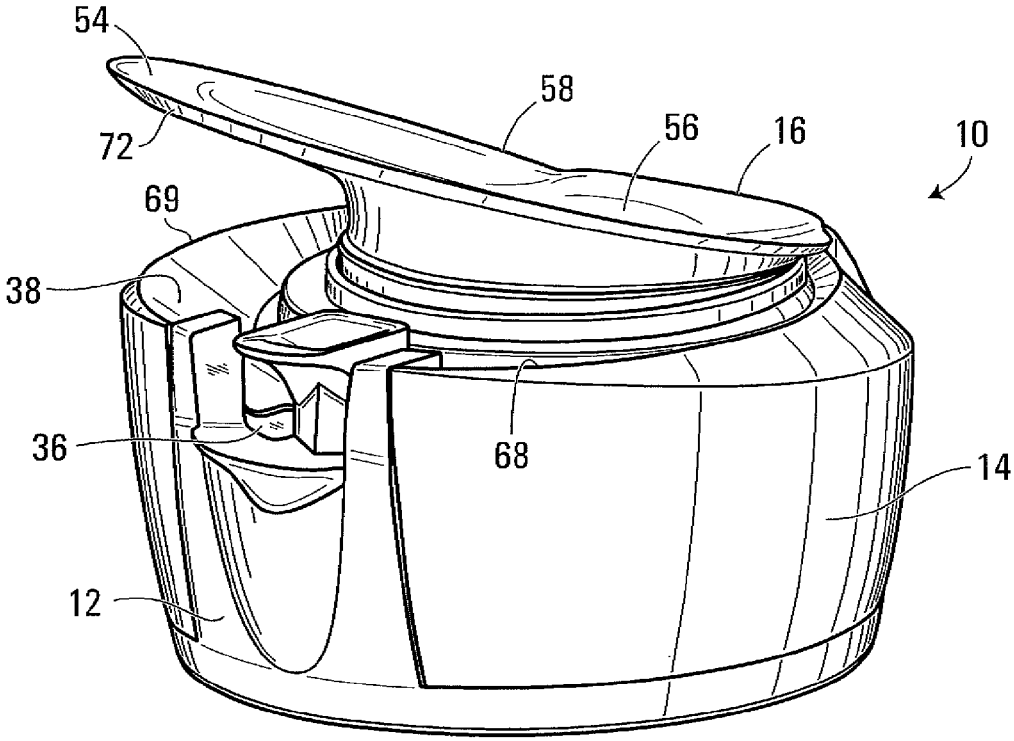
FIG. 3B shows a front perspective view of the cap in the open configuration.

The cap 10 can be mounted to the container 2 and has a seal 16 that is movable between a closed position, shown in FIGS. 1A, 1B, 3A, and 6, and an open position, shown in FIGS. 2A, 2B and 3B. As will be described more fully below, when the cap 10 is mounted to the container 2, the closed configuration is generally intended to give the cap a closed appearance, to block falling dust and other debris from penetrating within the container 2 and to impede the outward flow of consumable liquid through the cap from the interior of the container to the exterior, while in the open configuration, the passage of consumable liquid is unimpeded.

Unless explicitly or implicitly suggested otherwise, the various elements described herein are described from the perspective of a consumable liquid container that is standing upright on a flat surface and onto which the cap is affixed at a top portion. As such, orientationally descriptive terms such as 'upward', 'top', 'vertical' or 'upper', will generally refer to this particular frame of reference. However, it should be understood that this orientation is used only as an example to facilitate understanding of the invention, but that the invention is not limited to any particular orientation of its elements. For example, although the mouth 6 of the container described above is described as being defined at the upper portion 4, it should be understood that the container could be reoriented or otherwise shaped such that the portion defining the mouth 6 is no longer "up" without departing from the intended scope of the invention. Furthermore, the term longitudinal, as used herein designates a direction transversal to the mouth 6 of the container 2, the container interior and the cap 10. In the example shown, longitudinal refers to a direction relative to the cap 10 that is generally vertical when the cap 10 is mounted to the container 2 and the container 2 rests upright on a flat surface. However, it is to be understood that the present invention is not to be limited to the particular embodiment shown. Accordingly, alternate embodiment may comprise a mouth, cap and container that are curved or angled relative to one another.

The cap 10 comprises an inner member 12, and outer member 14, and the seal 16. In the example shown, these parts are shown in a particular configuration; however, it should be understood that all parts of the cap 10 and the cap 10 itself may vary in shape and relative size and that the invention is not intended to be limited to the particular shape shown in the figures.

The inner member 12 comprises a top portion 18 and a peripheral wall 20 extending downwardly from the top portion 18. The cap 10 is suited for attachment to container 2 at a mouth 6 of the container 2 by any appropriate retaining mean. When the cap is attached to the container, the peripheral wall 20 of the inner member 12 is said to cover the mouth 6 of the container. The peripheral wall 20 defines an opening 21 for receiving the mouth 6 of the container 2. The opening 21 is located around a first central axis 19. In the example shown, the central axis 19 of the opening 21 corresponds to the longitudinal central axis of the cap 10 and the container 2. In a non-limiting example, the peripheral wall 20 of the inner member 12 has threading 22 and can be twisted into matching threading 24 provided on the upper portion 4 of container 2. However, the particular retaining means used is not meant to limit the invention and in any arrangement when the mouth 6 of the container is covered by the cap, it is said that the peripheral wall of the member covers the mouth 6 of the container.

As best seen in FIGS. 1B and 2B, the inner member 12 comprises a first aperture 31 for facing the interior of the container 2 and a second aperture 32 defined by a spout 30, the first and second apertures 31, 32 being in liquid communication via a passage 33 provided in the inner member 12 for allowing consumable liquid to flow from the interior of the container 2 through the passage 33 and outwards. As such, when the seal 16 in the open position, and the cap 10 is mounted to the container 2, the container 2 can be tilted to pour out consumable liquid unimpededly from the interior of the container.

As best seen in FIGS. 1B, 2B, 4 and 5 the top portion 18 of the inner member 12 is defined by an inclined surface 25 converging at a lower opening 27 communicating with the interior of the container 2. The inclined surface 25 has a recess 26 extending transversely and in which the lower opening 27 is located. In the embodiment shown here, the lower opening 27 is in communication with a tubular passage 28 that extends towards the interior of the container 2. However, passage 28, is optional, the lower opening 27 may open directly into the interior of container 2. When consumable liquid, such as oil, drips onto the top portion 18 of the inner member 12, the inclined surface 25 directs it towards the lower opening 27, where it re-enters into the interior of container 2.

The spout 30 has four walls projecting upwardly from the top portion 18 to a top surface comprising the second aperture 32 defined by the spout. The spout 30 is free from surrounding elements, that is, it is surrounded by an area devoid of other elements such that it stands alone on the top portion 18. As such, consumable liquid dripping from the spout 30, or running down the sides of the spout 30 will fall down onto the top portion 18 of the inner member 12, where it will be collected and directed into the lower opening 27 due to the inclined surface 25 and recess 26.

Figure 4:
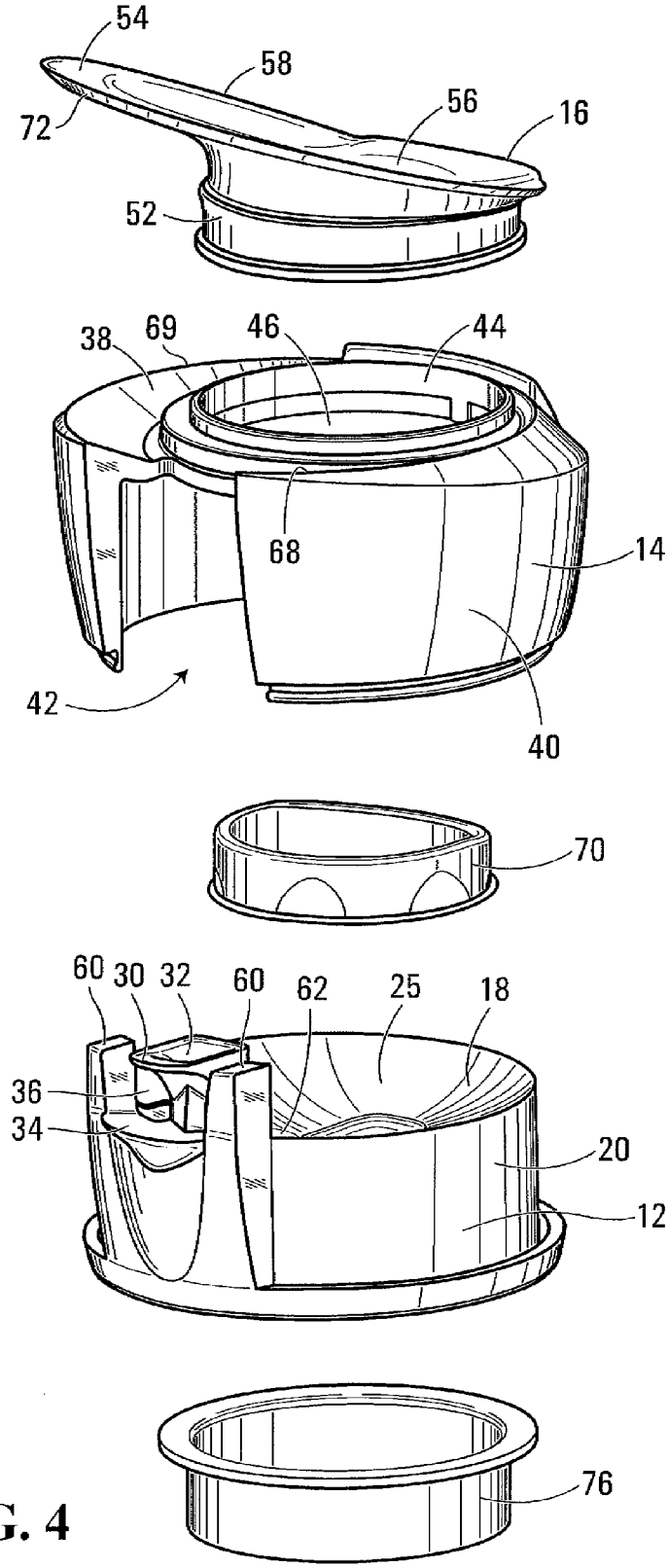
FIG. 4 shows an exploded view of the cap.
Figure 5:
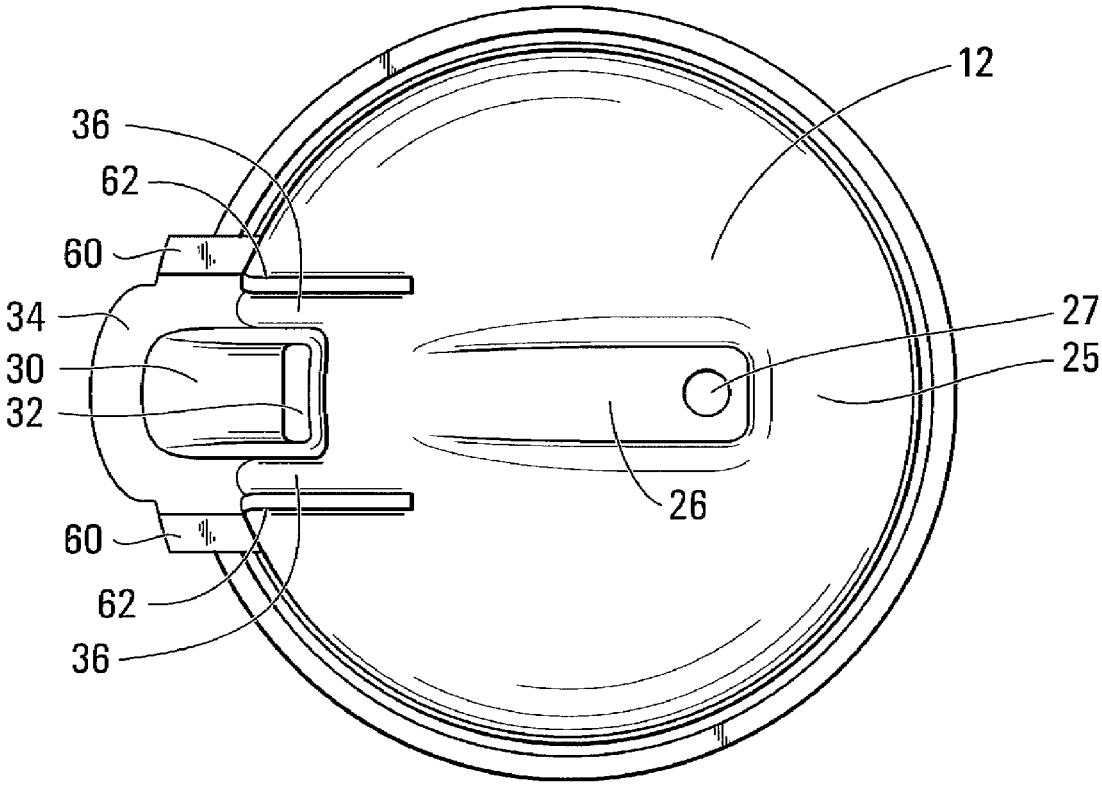
FIG. 5 shows a top plan view of an inner member of the cap with no other components shown.

As best seen in FIGS. 4 and 5, a pair of guiding walls 62 project upwardly from the top surface 18 and extend transversely on either side of the spout 30. The space over the top surface 18 between the guiding walls 62 and respective walls of the spout form a pair of channels 36 on respective sides of the spout 30. On either sides of the spout 30, a pair of posts 60 consisting of a left and a right post also project upwardly from the top surface 18 adjacent and on each side of said spout.

The inner member 12 also comprises a lip 34 located below the spout 30 and projecting outwardly from the inner member 12. The lip 34 is dimensioned so as to receive drops of consumable liquid dripping from the spout 30. Accordingly, the lip 34 projects from the inner member beneath the spout 30 and further than the spout 30 and is adapted to direct consumable liquid collected thereupon towards the channels 36, whereupon the consumable liquid, being on the inclined surface 25, is directed downwards into the lower opening 27 where it reenters into the interior of the container 2.

Thus the lip 34, channels 36, recess 26 and lower opening 27 cooperate to ensure that after consumable liquid is poured out of the spout, if one or more drops of liquid drip from the spout, they will not fall out of the cap or container or run down the side of the cap or container, but will be collected back into the interior of the container. It is to be noted that even if consumable liquid does not drip off the spout but rather runs down along the outside of the spout, it will still be received by the lip 34 or channels 36. The arrangement of the lower opening 27, recess 26, second aperture 32, spout 30, lip 34, and channels 36 is best seen on FIG. 5, which is a top plan view of the inner member 12.

Reverting to FIGS. 3B and 4, the outer member 14 comprises a top portion 38 and an external peripheral wall 40 extending downwardly therefrom. The top portion 38 of the outer member 14 partially covers the top portion 18 of the inner member 12 and the external peripheral wall 40 covers at least partially the peripheral wall 20 of the inner member 12. The external peripheral wall 40 of the outer member 14 extends downwardly over most of the longitudinal length of, and around most of the periphery of, the peripheral wall 20 of the inner member 12. However, as best seen in FIG. 4, the external peripheral wall 40 of the outer member 14 does not completely surround the peripheral wall 20 of the inner member 12 and an opening 42 is provided in the outer member 14 in which the posts 60, lip 34, and spout 30 are received. By virtue of the opening 42, the spout 30, lip 34 and channels 36 are not covered by the external peripheral wall 40. Furthermore, the opening 42 encompasses the posts 60 such that an edge of the external peripheral wall 40 abuts each of the posts 60 to prevent rotation of the outer member 14 relative to the inner member 12. It is to be understood that posts 60 are optional and that other means of preventing relative rotation between the inner member 12 and the outer member 14 may be provided, such as matching vertical ridges and grooves at the interface between the peripheral wall 20 of inner member 12 and the external peripheral wall 40 of the outer member 14.

The top portion 38 of the outer member 14 is adapted to direct any consumable liquid on it towards the channels 36. In particular, as seen in FIGS. 3B and 4 the top portion 38 is angled downwardly from first and second upper edge sections 68, 69 adjacent a peripheral portion of the top portion 38, and is angled towards the interior and opening 42 such that consumable liquid on the top portion 38 is urged towards the top portion 18 of the inner member 12.

As best seen in FIGS. 1B, 2B, and 4, the top portion 38 comprises an inner peripheral wall 44. The inner peripheral wall defines an inner aperture 46 having a second central axis 48 which is spaced apart from the first central axis 19. The inner aperture 46 defined by the inner peripheral wall 44 of the outer member 14 is not centered relative to the cap 10 and container 2 and is rather slightly offset relative to the first central axis 19. That is, the inner aperture 46 is not centered along the same longitudinal axis as the lower opening 21. As such the first central axis 19 and the second central axis 48 can be said to be spaced apart from one another.

In FIG. 5, the opening 21 defined by the peripherals wall 20 of the inner member 12 is hidden by the top portion 18 of the inner member 12, however it is approximately in the center of the cap 10. The inner aperture 46 of the outer member 14 is offset from the center of the cap 10.

The seal 16 is made of a flexible material and it comprises a top portion 58, which is the only portion of the seal 16 visible in FIGS. 1A, 2A, 3A, and 6. The top portion 58 comprises a depressible portion 56 located around the second central axis 48 and overlying the inner aperture 46.

The seal 16 further comprises a flange portion 54 which overlaps and covers the spout 30 when the seal 16 is in the closed position for obstructing the liquid passage through the spout 30 and for hampering the outward flow of liquids through the cap 10, as shown in FIGS. 1A and 1B. The flange portion 54 at least partially surrounds the depressible portion 56. In the example shown, the flange portion 54 extends around a majority of the periphery of the depressible portion 56, but does not surround the entire depressible portion 56. Indeed, the flange portion 54 does not extend to the part of the periphery of the depressible portion 56 that is opposite the spout 30. However, it is to be understood that the flange portion 54 could extend around the entire periphery of the depressible portion 56. In such a case, because the depressible portion 56 surrounds the second central axis 48, which is not central to the cap 10 in the present example, the flange portion 54 may not be of equal width all around the depressible portion 56, even though it would surround it.

Figure 7:
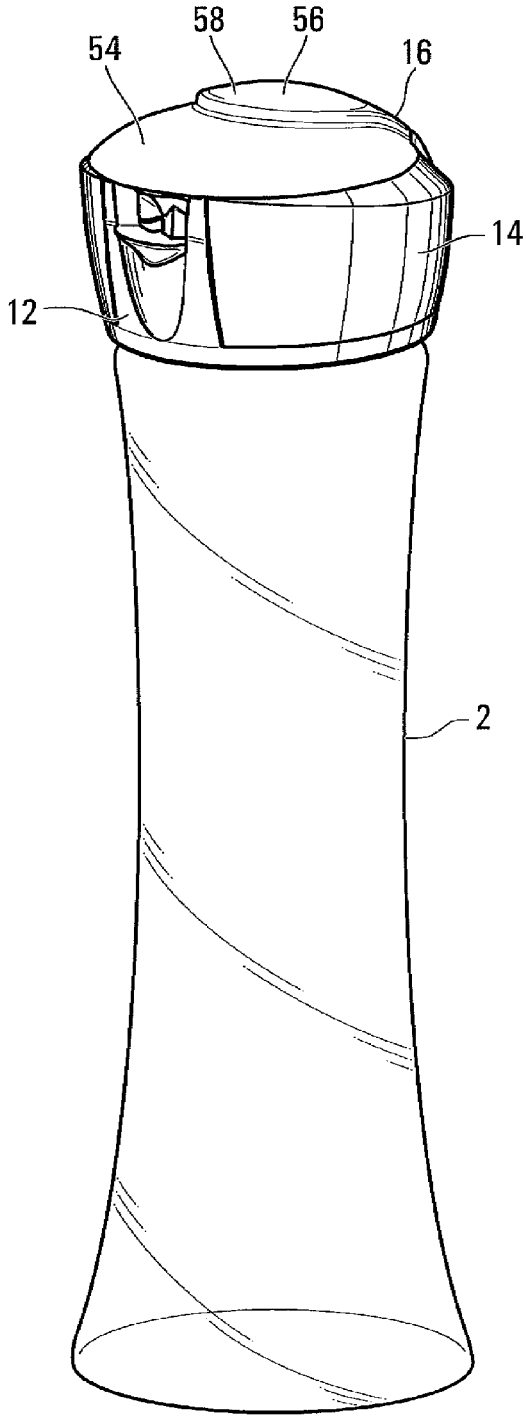
FIG. 7 shows a front perspective view of the cap mounted to a consumable liquid container.

The flange portion 54 has an external edge 72. When the seal 16 is in the closed position, the external edge 72 at least partially contacts the top surface of the walls of the spout 30 for obstructing the liquid passage through the spout 30 and hampering the outward flow of liquids through the cap 10. As best seen in FIGS. 1B, 3A and 7, the external edge 16 of the seal contacts the outermost wall of the spout 30. Due to this contact, when the seal 16 is in the closed position and in normal use, liquid will not pass through the spout outwards even as the container 2 is slightly tilted or shaken, for example as it is transported from one place to another. When in the closed position, the external edge 72 also contacts the top surface of the posts 60 and the first and second upper edge sections 69, 69 of the top portion 38 of the outer member 14. Thus, even if consumable liquid is, by tilting of the container 2, urged out of the spout 30 and into the area over the top portion 38, it will be prevented from flowing to the over the posts 60 or the upper edge sections 68, 69 by the contact between the external edge 72 with the posts 60 and upper edge sections 68, 69 and, within a normal range of motion and orientation of the container 2, will be directed through the opening 42 back onto the top portion 18 of the inner member 12 by the top portion 38 of the outer member 14 whereupon it will be directed back into the interior of the container 2 through the lower opening 27, as already described above. In the particular embodiment shown, if the container 2 experiences an extreme tilt or shake, liquid may still flow outward through the spout 30, over the top portion 18 of the inner member 12 on the inward side of the spout 30 and out through the channels 36. Liquid may also flow out through the lower opening 27 over the top portion 18 of the inner member 12 and out through the channels 36. In an alternate embodiment, the external edge 72 could completely cover the second aperture 32 and thus prevent outward flow of liquid through the spout altogether when in the closed position. Channels 36 may also be absent or equally covered by the seal 16 such that no liquid whatsoever can flow outwards when the seal 16 is in the closed position.

The seal 16 further comprises a peripheral wall 52 extending downwardly from the top portion 58. An upper end 64 of the peripheral wall 52 joins the top portion 58 between the flange portion 54 and the depressible portion 56 in an area surrounding the depressible portion 56. The peripheral wall 52 extends downwardly from the upper end 64 to a lower end 68 in an area adjacent the inner aperture 46.

The lower end 68 of the peripheral wall 52 can be held against the inner peripheral wall 44 by any suitable means. In the example shown here, the peripheral wall 52 is held against the entire periphery of the inner peripheral wall by a ring 70 received in the inner aperture 46. The lower end 68 of the peripheral wall 52 is sandwiched between the inner peripheral wall 44 and the ring 70 such that it is held in place and such that consumable liquid cannot flow between the peripheral wall 52 and the inner peripheral wall 44. Thus, the inner aperture 46 is completely sealed by the peripheral wall 52 such that no consumable liquid can flow outward to the exterior of the cap 10 and the container 2 through the inner aperture 46. Therefore, the only passages between the interior of the container 2 and the exterior are via the first aperture 31, passage 33, and second aperture 32, and via the channels 36, recess 26, lower opening 27 and tubular passage 28.

In the example shown here, the peripheral wall 52 extends downwardly around the entire periphery of the depressible portion 56, however it is to be appreciated that in alternate embodiments, the peripheral wall 52 may be disposed differently. For example, the peripheral wall 52 could extend only below the area of the top portion 58 where the flange portion 54 and the depressible portion 56 meet; the top portion 58 being itself held or glued against the outer member 14 around the area of the periphery of the depressible portion 56 not surrounded by the flange portion 54. Furthermore, the peripheral wall 52 may be held against the inner peripheral surface 44 by means other than a ring such as gluing or overmolding.

The upper end 64 of the peripheral wall 52 comprises a live hinge 66. When a user applies pressure on the depressible portion 56 of the seal 16, the depressible portion 56 is moved downwardly along the second central axis 48 and the flange portion 54 moves upwardly to free the spout 30. The seal 16 thus adopts the open position shown in FIGS. 2A, 2B and 3B. Passage of consumable liquid outwards from the interior of the container 2 through the first aperture 31, the passage 33 and the second aperture 32 is thus unimpeded when the seal 16 is in the open position. In the example shown, when the seal is moved from the closed position to the open position, the entire flange portion 54 moves from a downward angle relative the live hinge 66 to an upward angle and its external edge 72 disengages the top portion 38 of the outer member 14. The container 2 with the cap 10 can then be tilted to allow outward flow of the consumable liquid held in the interior of the container 2 outward through the first aperture 31, the passage 33 and the second aperture 32.

Thus, when the seal 16 is in the closed position, the depressible portion 56 is above the flange portion 54, and the flange portion 54 covers the spout 30, as shown in FIG. 1B. When the seal 16 is in the open position, the flange portion 54 extends upwardly above the depressible portion 56 so as to free the second opening 32 and to allow unimpeded passage of consumable liquid outwards from the interior of the container 2 through the spout 30.

In addition to allowing consumable liquid to be poured out of the spout 30 and to permit consumable liquid to be collected back into the container 2, the inner member 12 and outer member 14 also permit air to flow into the container 2 while pouring, as will now be described.

As best seen on FIGS. 1B, 2B and 5, the pair of channels 36, recess 26, lower opening 27, and tubular passage 28 together form a liquid passage between the interior of the container 2 and the exterior through the cap 10. More specifically, the channels 36 form a liquid communication passage between the recess 26 and the exterior of the container 2 and cap 10 while the lower opening 27 and passage 28 form a liquid communication passage between the interior of the container 2 and the recess 26. When consumable liquid is poured from the spout 30, air can also penetrate into the interior of the container 2 through the lower opening 27 and passage 28 to replace the volume of consumable liquid being poured out. As a result, consumable liquids can pour out through the spout 30 smoothly, without the risk of bubbles interrupting the flow.

FIG. 4 shows an exploded view of the cap 10. An optional container insert 76 is shown here. The container insert 76 is a piece of rubber or rubber-like material sized to fit in the mouth 6 of the container 2 and to cover the top of the container 2 around the mouth 6. When the cap 10 is screwed, or otherwise fastened onto the container 2, it is pressed against the container insert 76 and thus forms a tight seal against the mouth 6 of the container 2, thus preventing consumable liquid from escaping between the mouth 6 of the container 2 and the cap 10.

The seal 16 can be made of injection molded silicone, compression molded silicone, thermoplastic rubber (TPR) or natural rubber.

It is to be understood that the invention is not intended to be limited to the embodiment shown here and that the seal 16 may prevent the flow of consumable liquid outward in any suitable manner. For example, in the alternate embodiment suggested above, where when the seal 16 is in the closed position, the external edge 72 completely covers the second aperture 32, the flange need only extend around the portion of the periphery of the depressible portion 56 where the spout is located, and there may be no upper edge sections 68 and 69.

Although a particular embodiment has been illustrated, this was for the purpose of describing, but not limiting, the invention. Various modifications will become apparent to those skilled in the art and are within the scope of this invention, which is defined more particularly by the attached claims.

The invention claimed is:

1. A cap for a container defining an interior for storing consumable liquid and having an upper portion defining a mouth, said cap comprising:

(a) an inner member having a top portion with a peripheral wall extending downwardly for covering a mouth of a container and defining an opening having a first central axis, said peripheral wall of said inner member having means for retaining said cap onto the container, said inner member further comprising a first aperture for facing an interior of the container and a second aperture defined by a spout extending upwardly from said top portion, said first and second apertures being in liquid communication for allowing passage of the consumable liquid;

(b) an outer member having a top portion, an inner peripheral wall defining an inner aperture having a second central axis spaced apart from said first central axis, and an external peripheral wall extending downwardly from said top portion of said outer member for covering at least partially said peripheral wall of said inner member; and (c) a seal made of a flexible material and comprising (i) a top section having a depressible portion and a flange portion having an external edge, said depressible portion being located around said second central axis and said flange portion at least partially surrounding said depressible portion for overlapping said spout, and (ii) a peripheral wall extending downwardly from said top section and having a lower end mounted to said outer member in an area adjacent said inner aperture of said outer member;

wherein said seal is in a closed position when said depressible portion is above said flange portion and said flange portion has a portion covering said spout for hampering the outward flow of consumable liquid through said spout, and wherein, upon pressure of a user on said depressible portion, said depressible portion is moved downwardly along said second central axis such that said flange portion is above said depressible portion and frees said spout for allowing unimpeded passage of the consumable liquid outwards from the interior of the container.

2. A cap as defined in claim 1, wherein said peripheral wall of said seal has an upper end that joins said top section between said depressible portion and said flange portion.

3. A cap as defined in claim 2, wherein said upper end of said peripheral wall of said seal completely surrounds said depressible portion.

4. A cap as defined in claim 3, wherein said upper end of said peripheral wall of said seal comprises a live hinge.

5. A cap as defined in claim 3, wherein said peripheral wall of said seal is received within said inner aperture of said outer member.

6. A cap as defined in claim 5, further comprising a ring received in said inner aperture of said outer member for holding said peripheral wall of said seal against said inner peripheral wall of said outer member.

7. A cap as defined in claim 5, wherein said peripheral wall of said seal completely seals said inner aperture of said outer member such that no liquid can escape through said inner aperture of said outer member.

8. A cap as defined in claim 1, wherein said top portion of said outer member comprises first and second upper edge sections located on opposite sides of said spout, and wherein said external edge of said flange portion of said seal contacts said first and second upper edge sections when said seal is in said closed position.

9. A cap as defined in claim 1, wherein said top portion of said inner member is defined by an inclined surface converging towards a lower opening communicating with the interior of the container.

10. A cap as defined in claim 9, wherein said spout is free from surrounding elements.

11. A cap as defined in claim 10, wherein said inner member further comprises a lip being located below said spout and projecting outwardly such that consumable liquids dripping from, or running down, said spout are collected by said lip and directed towards said lower opening of said top portion of said inner member.

12. A cap as defined in claim 11, wherein said top portion of said inner member further comprises a pair of channels defining a passage alongside respective sides of said spout, each passage being in liquid communication with said lip for directing the collected consumable liquid towards said lower opening of said inclined surface.

13. A cap as defined in claim 12, wherein said inclined surface has a recess and wherein said lower opening is located in said recess and said recess extends transversely for being in liquid communication with each channel.

14. A cap as defined in claim 8, wherein said inner member further comprises left and right posts located adjacent and on each side of said spout.

15. A cap as defined in claim 14, wherein said peripheral wall of said outer member has an opening for receiving said left and right posts and said spout.

16. A cap as defined in claim 15, wherein said external edge of said flange portion of said seal also contacts top surface of said left and right posts when said seal is in said closed position.

17. A cap for a container defining an interior for storing consumable liquid and having an upper portion defining a mouth, said cap comprising:

(a) an inner member having a top portion with a peripheral wall extending downwardly for covering a mouth of a container and defining an opening, said peripheral wall of said inner member having means for retaining said cap onto the container, said inner member further comprising a first aperture for facing an interior of the container and a second aperture defined by a spout extending upwardly from said top portion, said first and second apertures being in liquid communication for allowing passage of the consumable liquid;

(b) an outer member having a top portion, an inner peripheral wall defining an inner aperture, and an external peripheral wall extending downwardly from said top portion of said outer member for covering at least partially said peripheral wall of said inner member; and (c) a seal made of a flexible material and comprising (i) a top section having a depressible portion and a flange portion at least partially surrounding said depressible portion for overlapping said spout and (ii) a peripheral wall extending downwardly from said top section and having a lower end mounted to said outer member in an area adjacent said inner aperture of said outer member;

wherein said seal is in a closed position when said depressible portion is above said flange portion and said flange portion has a portion covering said spout for hampering the outward flow of consumable liquid through said spout, and wherein, upon pressure of a user on said depressible portion, said depressible portion is moved downwardly such that said flange portion is above said depressible portion and frees said spout for allowing unimpeded passage of the consumable liquid outwards from the interior of the container;

wherein said top portion of said inner member is defined by an inclined surface converging towards a lower opening communicating with the interior of the container;

wherein said spout is free from surrounding elements; and wherein said inner member further comprises a lip located below said spout and projecting outwardly such that consumable liquids dripping from, or running down, said spout are collected by said lip and directed towards said lower opening of said top portion of said inner member.

18. A cap as defined in claim 17, wherein said top portion of said inner member further comprises a pair of channels defining a passage alongside respective sides of said spout, each passage being in liquid communication with said lip for directing the collected consumable liquid towards said lower opening of said inclined surface.

19. A cap as defined in claim 18, wherein said inclined surface has a recess and wherein said lower opening is located in said recess and said recess extends transversely for being in liquid communication with each channel.

20. A cap as defined in claim 19, wherein said inner member further comprises left and right posts located adjacent and on each side of said spout.

21. A cap as defined in claim 20, wherein said peripheral wall of said outer member has an opening for receiving said left and right posts and said spout.

* * * * *